US005261738A

United States Patent [19]

Brock

[11] Patent Number: 5,261,738

[45] Date of Patent: Nov. 16, 1993

[54] ASPHALT DRUM MIXER WITH BYPASS FOR CONTROLLING THE TEMPERATURE OF THE EXHAUST GAS

[75] Inventor: J. Donald Brock, Chattanooga, Tenn.

[73] Assignee: Astec Industries, Inc., Chattanooga, Tenn.

[21] Appl. No.: 951,135

[22] Filed: Sep. 25, 1992

[51] Int. Cl.[5] ..... B28C 5/46

[52] U.S. Cl. ..... 366/25; 34/136; 34/137; 366/33; 366/57; 432/117

[58] Field of Search ..... 366/4, 7, 22–25, 366/27, 40, 42, 64, 228, 233, 235, 290, 57, 33; 34/136, 137; 432/105, 108, 111, 113, 117, 118

[56] References Cited

U.S. PATENT DOCUMENTS

| | | | |
|---|---|---|---|
| 1,056,121 | 3/1913 | Prindle | 34/136 X |
| 2,421,345 | 5/1947 | McConnaughay | 366/25 |
| 4,136,966 | 1/1979 | Mendenhall | 366/25 |
| 4,190,370 | 2/1980 | Brock et al. | 366/25 |
| 4,279,592 | 7/1981 | Grant | 432/105 |
| 4,298,287 | 11/1981 | McCarter, III et al. | 366/25 X |
| 4,332,478 | 6/1982 | Binz | 366/25 X |
| 4,398,826 | 8/1983 | Mendenhall | 366/25 |
| 4,522,498 | 6/1985 | Mendenhall | 366/4 |
| 4,600,379 | 7/1986 | Elliott | 366/25 X |
| 4,867,572 | 9/1989 | Brock et al. | 366/25 |
| 4,892,411 | 1/1990 | Elliott et al. | 34/137 X |
| 5,052,810 | 10/1991 | Brock | 366/25 |
| 5,067,254 | 11/1991 | Linkletter et al. | 432/105 X |

FOREIGN PATENT DOCUMENTS

| | | | |
|---|---|---|---|
| 882078 | 5/1943 | France | 34/136 |
| 3235803 | 10/1991 | Japan | 366/25 |
| 897916 | 1/1982 | U.S.S.R. | 366/4 |

*Primary Examiner*—Stephen F. Gerrity
*Assistant Examiner*—Charles Cooley
*Attorney, Agent, or Firm*—Nilles & Nilles

[57] ABSTRACT

A drum mixer which is useful in the continuous production of asphalt paving composition. The mixer includes a hollow drum which is mounted for rotation about an inclined axis, and the aggregate is introduced into the upper end of the drum so that as the drum rotates, the aggregate cascades through the interior of the drum and moves toward a discharge outlet at the lower end of the drum. A burner is mounted adjacent one end of the drum so that a heated gas passes through cascading aggregate. To permit the temperature of the exhaust gas to be maintained within acceptable limits so as to avoid detrimental effects to a downstream filtering baghouse, a gas flow bypass system is mounted in the downstream end portion of the drum. The bypass system may be selectively opened and closed, so that a portion of the heated gas may be selectively permitted to pass through a portion of the length of the drum and to the exhaust duct without passing through the cascading aggregate, which causes the temperature of the exhaust gas to rise. Upon the bypass tube system being closed, all of the heated gas flows through the cascading aggregate and the temperature of the exhaust gas is thus lowered.

18 Claims, 3 Drawing Sheets

ASPHALT DRUM MIXER WITH BYPASS FOR CONTROLLING THE TEMPERATURE OF THE EXHAUST GAS

BACKGROUND OF THE INVENTION

The present invention relates to an asphalt drum mixer of the type employed to continuously heat and dry stone aggregate, while mixing the heated and dried aggregate with liquid asphalt to produce asphalt paving composition.

In one conventional drum mixer of the described type, the aggregate drying and mixing steps are carried out in a rotating drum which is inclined from the horizontal. The virgin aggregate is introduced into the upper end of the drum, and an outlet is provided adjacent the lower end of the drum for withdrawing the heated and dried aggregate. Thus as the drum rotates, the aggregate cascades through the interior of the drum and moves toward the outlet at the lower end. A burner is mounted adjacent the upper end of the drum so as to create a heated gas stream which moves through the drum in a direction parallel to the moving aggregate. Also, liquid asphalt is introduced into the interior of the drum at a location midway along its length, and so that the asphalt becomes mixed with the cascading aggregate and so as to produce a paving composition which exits from the outlet. In some designs, the drum includes a center inlet by which recyclable asphalt product (RAP) may be introduced into the drum so as to be mixed with the aggregate and liquid asphalt. A drum mixer of this general type is disclosed in the U.S. Pat. No. 4,332,478, to Binz.

In another conventional drum mixer, the drum is constructed so that the heated gas flows counter to the direction of movement of the aggregate. A mixer of this type is disclosed in U.S. Pat. No. 4,867,572 to Brock et al. More particularly, in the drum mixer of the Brock et al patent, a fixed sleeve surrounds the lower portion of the rotating drum so that the heated and dried aggregate is discharged into the annular chamber which is formed between the drum and sleeve. Also, an inlet is provided in the sleeve by which RAP may be introduced into the annular chamber, and another inlet is provided to introduce liquid asphalt into the annular chamber. The drum mounts mixing blades which are positioned in the annular chamber to mix the materials and cause them to be moved longitudinally to the discharge outlet of the sleeve.

In drum mixers of the described type, it is common to utilize a filtering baghouse to remove particulate matter from the exhaust gas of the mixer. Also, it is recognized that condensation of moisture or acid in the baghouse is detrimental, in that such condensation promotes corrosion and tends to blind the filtering bags. Thus the temperature of the exhaust gas should be maintained at a minimum level to minimize such condensation. However, excessive heat is also a problem, in that it tends to destroy the filtering bags. Thus it is important that the temperature of the exhaust gas from the mixer be maintained within acceptable limits.

U.S. Pat. No. 5,052,810 to Brock discloses a drum mixer having an improved capability of maintaining the exhaust gas temperature within acceptable limits under varying operating conditions. Specifically, the '810 patent discloses the use of a gas flow bypass tube which is mounted coaxially within the downstream end of the drum. The tube may be selectively opened and closed, and upon opening the bypass tube, a portion of the heated gas is able to pass freely through a portion of the length of the tube and to the exhaust duct, without passing through the cascading aggregate. Thus the temperature of the exhaust gas rises. Upon the bypass tube being closed, all of the heated gas flows through the cascading aggregate, and the temperature of the exhaust gas is lowered.

While the bypass tube of the '810 patent represents a significant improvement, the size and length of the bypass tube has resulted in an interference with the proper showering of the cascading aggregate in the drum, and thus the heat transferred to the aggregate becomes somewhat unpredictable.

It is accordingly an object of the present invention to provide a drum mixer of the described type which is useful in the continuous production of asphalt paving composition, and which has the ability to maintain the exhaust gas temperature within acceptable limits under varying operating conditions.

It is a further object of the present invention to provide a drum mixer of the described type which does not significantly interfere with the proper showering of the cascading aggregate in the drum, and so that the heat transfer to the aggregate is predictable.

SUMMARY OF THE INVENTION

The above and other objects and advantages of the present invention are achieved in the embodiments illustrated herein by the provision of a drum mixer which comprises an elongate hollow drum defining a central axis, and which is mounted for rotation about the central axis and with the central axis being inclined with respect to the horizontal so as to define an upper end and a lower end of the drum. Aggregate inlet means is positioned adjacent the upper end of the drum for introducing aggregate into the interior of the drum, and aggregate outlet means is positioned adjacent the lower end of the drum for withdrawing aggregate from the interior of the drum. Means are also provided for rotating the drum about the central axis so as to cause the aggregate which is introduced at the inlet means to cascade through the interior of the drum and move to the outlet means, and heating means is positioned adjacent one of the ends of the drum for introducing heated gas into the interior of the drum. Further, exhaust duct means is positioned adjacent the other of the ends of the drum for exhausting the heated gas therefrom and so that the heated gas flows through the drum.

To permit the temperature of the exhaust gas to be effectively controlled in accordance with the present invention, there is further provided gas flow bypass means which is positioned within the interior of the drum for selectively permitting some of the heated gas flowing through the drum to pass freely through a portion of the length of the drum without passing through the cascading aggregate.

The gas flow bypass means preferably comprises at least one axially directed elongate tube positioned within the drum adjacent the wall thereof, and with the tube defining an upstream end and a downstream end. A relatively short central tube is mounted coaxially within the drum and so as to be radially aligned with the downstream end of the elongate tube. Also, a radial tube interconnects the downstream end of the elongate tube and the central tube. Further, valve means is provided for selectively closing the central tube so as to control the flow of heated gasses through the central tube and through the one elongate tube.

In a preferred embodiment, the gas flow bypass means includes a plurality of the elongate tubes and so as to be angularly separated from each other when viewed in transverse cross section. Also, a like number of the radial tubes interconnect respective ones of the elongate tubes with the central tube.

The drum mixer also preferably includes a plurality of axially extending mixing flights mounted to the wall of the drum so as to be positioned within the drum, and each of the elongate tubes is mounted immediately behind one of said mixing flights when viewed in the direction of rotation of said drum.

In a counterflow type mixer, the heating means is disposed adjacent the lower end of the drum, so that the aggregate moving through the drum moves counter to the direction of gas flow through the drum. Also, a fixed sleeve coaxially surrounds a portion of the length of the drum and so as to define an annular chamber between the drum and sleeve. The sleeve has a lower end which overlies the outlet means of the drum and means are provided for mixing the aggregate with a liquid asphalt in the annular chamber.

In a parallel flow type mixer, the heating means is positioned adjacent the upper end of the drum, so that the aggregate moves through the drum in a direction parallel to the direction of gas flow through the drum. In this latter embodiment, the liquid asphalt is introduced into the interior of the drum so as to be mixed with the aggregate therein.

BRIEF DESCRIPTION OF THE DRAWINGS

Some of the objects and advantages of the present invention having been stated, others will appear as the description proceeds, when taken in conjunction with the accompanying schematic drawings in which.

DETAILED DESCRIPTION OF THE PREFERRED EMBODIMENTS

Figure 1:
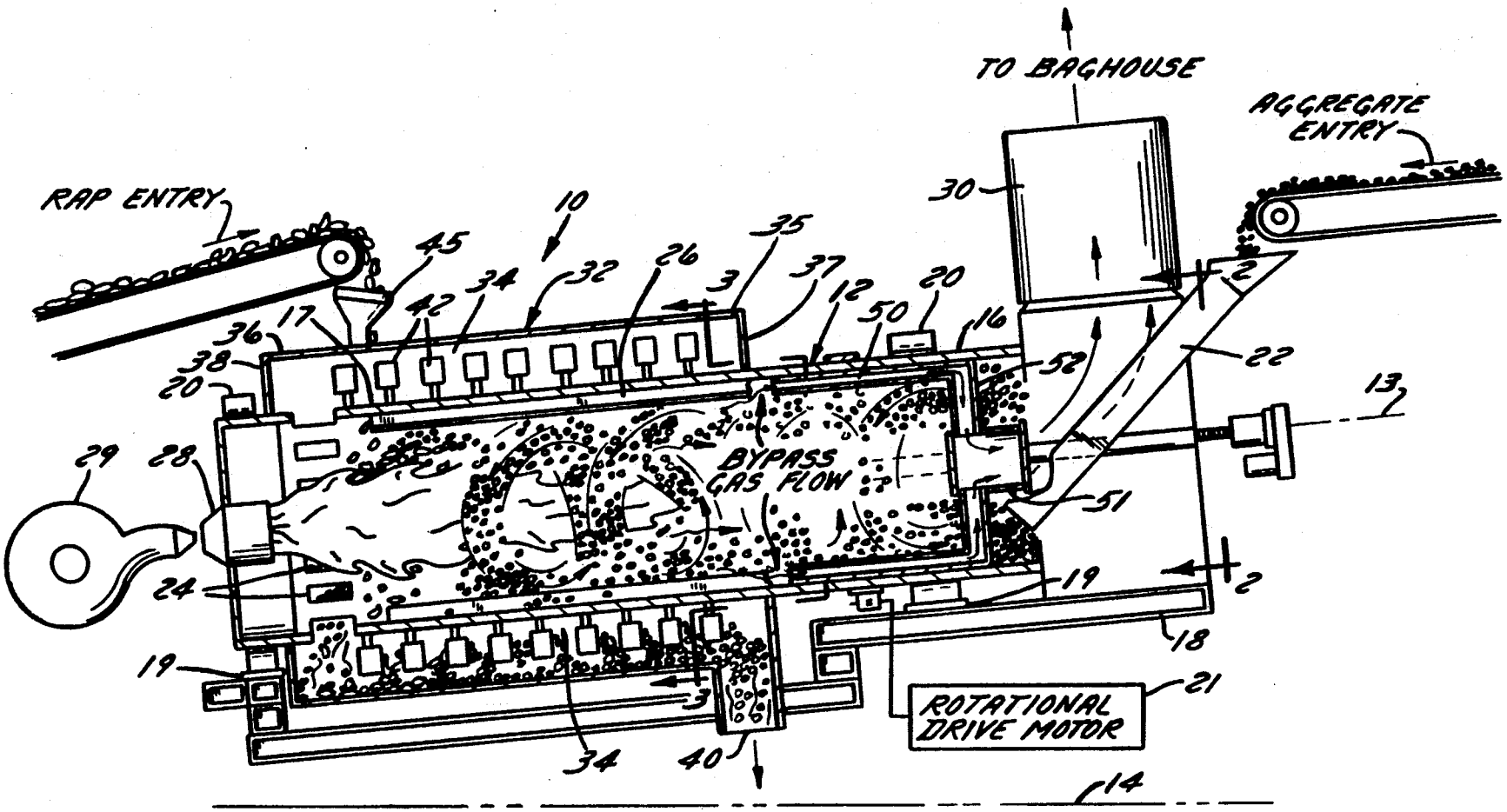
FIG. 1 is a partially sectioned side elevation view of a drum mixer which embodies the features of the present invention.
Figure 2:
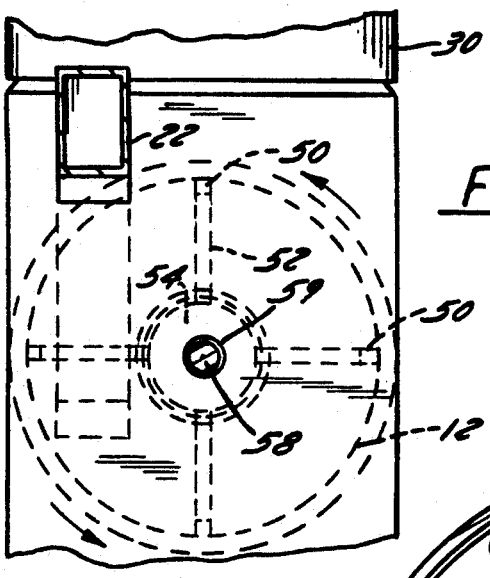
FIG. 2 is a rear end view taken substantially along the line 2—2 in FIG. 1.

Referring more particularly to the drawings, FIG. 1 illustrates a drum mixer 10 in accordance with one preferred embodiment of the present invention. The mixer comprises an elongate hollow drum 12 defining a central axis 13, and the drum is mounted for rotation about the central axis and with the central axis being inclined with respect the horizontal 14 so as to define an upper end 16 and a lower end 17 of the drum.

The drum 12 is rotatably mounted on a frame 18 by means of bearings 19 mounted to the frame which engage races 20 which are mounted about the circumference of the drum. A motor which is schematically illustrated at 21 rotatably drives the drum in a conventional manner and as further illustrated for example in the above noted patent to Brock et al, the disclosure of which is incorporated herein by reference. An aggregate inlet chute 22 is positioned adjacent the upper end of the drum for introducing stone aggregate or the like into the interior of the drum. The inlet chute is preferably provided with an air sealing flop gate (not shown) of conventional design. Also, a plurality of outlet openings 24 are formed about the periphery of the drum at the lower end thereof for withdrawing aggregate from the interior of the drum in the manner further described below.

A plurality of flights or vanes 26 are mounted on the inside of the drum, for lifting the aggregate and dropping the same through the interior of the mixer as it is rotated. As is conventional, the flights 26 may be of different configurations in different portions of the drum. Thus the aggregate which is introduced into the drum via the inlet chute 22 is caused to cascade through the interior of the drum, and move toward the outlet openings 24.

The drum mixer 10 further includes a burner 28 which is mounted at the lower end of the drum for directing a high temperature flame into the interior of the drum. The burner 28 is of conventional design, and it includes a blower 29 which charges a mixture of fuel and air into the burner, where it is ignited to produce a flame for heating the interior of the drum. An exhaust duct 30 is positioned at the upper end of the drum, which may include an exhaust fan (not shown) for exhausting the heated gas from the drum and so that the heated gas flows through the drum to heat the cascading aggregate. The exhaust air flow is ducted to a conventional filtering baghouse (not shown) or other dust collector.

The drum mixer 10 further comprises a fixed sleeve 32 which is mounted coaxially about a portion of the length of the drum 12 adjacent the lower end 17 thereof, and so that the drum and sleeve define an annular chamber 34 therebetween. The sleeve 32 is thus similarly inclined to the horizontal, so as to define an upper end 35 and a lower end 36. The sleeve also includes annular shoulders 37, 38 at each end thereof to close the annular chamber 34 between the drum and the sleeve, and the lower end 36 of the sleeve 34 overlies the outlet openings 24 of the drum 12 so that the outlet openings 24 open into the annular chamber 34. Thus the heated and dried aggregate in the lower end of the drum falls into the annular chamber during rotation of the drum. The sleeve 32 further includes a discharge opening 40 adjacent the upper end thereof, which preferably also includes an air sealing flop gate (not shown).

A plurality of paddle like flights or mixing blades 42 are mounted on the outer circumference of the drum along the portion of the drum received within the sleeve. The blades 42 are configured and angled such that as the blades traverse the annular chamber 34, they engage the aggregate in the annular chamber and move the aggregate toward the discharge opening 40 of the sleeve, while causing the aggregate to be mixed.

Figure 3:
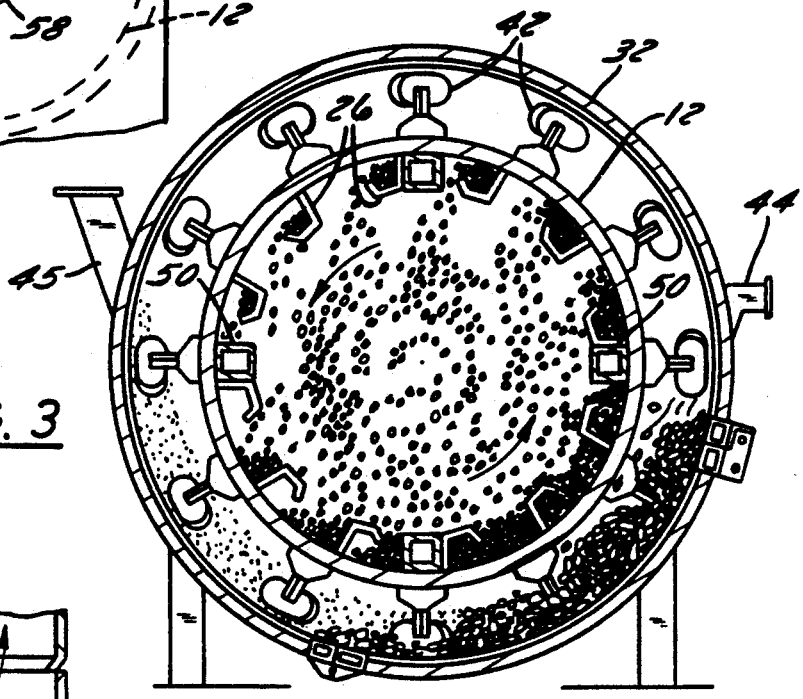
FIG. 3 is an enlarged sectional view taken substantially along the line 3—3 of FIG. 1.

A liquid asphalt supply pipe 44 (FIG. 3) communicates with the annular chamber 34 for introducing liquid asphalt into the chamber so as to be mixed with the aggregate therein. Further, an inlet 45 positioned adjacent the lower end of the sleeve permits an additive, such as recyclable asphalt pavement, to be introduced into the annular chamber and so as to be mixed with the aggregate and the liquid asphalt therein. The inlet 45 may also include an air sealing flop gate (not shown).

The resulting asphalt paving composition is discharged through the discharge opening 40 of the sleeve.

In accordance with the present invention, the drum mixer 10 further includes a gas flow bypass means which is positioned within the interior of the drum adjacent the upper (i.e. downstream) end 16 thereof, for selectively permitting some of the heated gas flowing through the drum to pass freely through a portion of the length of the drum and to the exhaust duct 30, without passing through the cascading aggregate. In the illustrated embodiment, this gas flow bypass means comprises four axially directed elongate tubes 50 mounted within the drum adjacent the outer wall thereof. As will be apparent, the number and size of the tubes 50 can vary, and as illustrated, they extend for a substantial portion, but less than about one half, of the axial length of the drum. Further, the tubes 50 are each mounted immediately behind one of the mixing flights 26 when viewed in the direction of rotation of the drum.

The tubes 50 define aligned upstream ends and aligned downstream ends, and the gas flow bypass means further includes a relatively short central tube 51 which is mounted coaxially within the drum and so as to be radially aligned with the downstream ends of the tubes 50. Further, four radial tubes 52 interconnect the downstream end of respective ones of the tubes 50 and the central tube 51. It will also be noted that the upstream end of the central tube 51 is closed, while the downstream end is open. The radial tubes 52 further serve to mount the central tube 51 in the described position.

Figure 4:
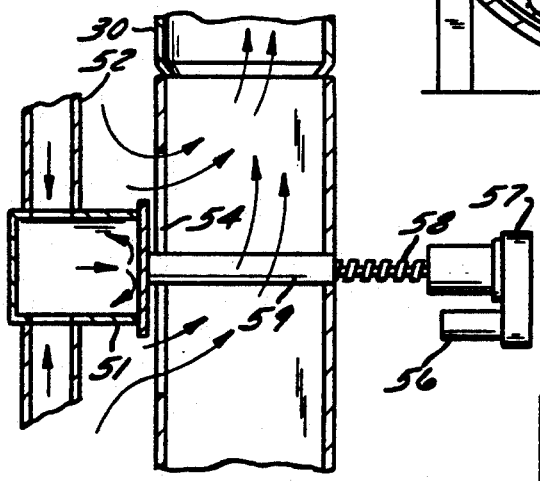
FIGS. 4 and 5 are fragmentary side elevation views of the rear portion of the drum and illustrating the closed and open positions of the gas flow bypass system respectively.
Figure 5:
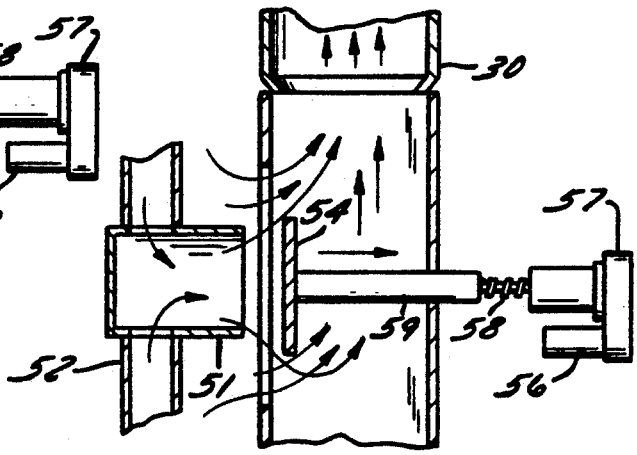

Valve means is also provided for selectively opening and closing the central tube 51 so as to control the flow of heated gasses through the central tube 51 and the elongate tubes 50. This valve means includes a plate 54 mounted for movement between a closed position as seen in FIG. 4 closing the downstream end of the tube 51, and an open position as seen in FIG. 5 axially withdrawn from the downstream end of the tube 51. This movement is controlled by a drive means which is designed to selectively move the plate 54 between the open and closed positions, and to any selected intermediate position. The drive means comprises an electric motor 56, which is mounted outside of the discharge duct, and which is operatively connected via a gear reducer 57, to a threaded lead screw 58 which extends along the central axis 13 of the drum. A non-rotatable sleeve 59 is fixedly connected to the plate 54, and is threadedly received on the lead screw 58, so that rotation of the screw causes the sleeve and thus the plate to move axially between the closed and open positions.

In the illustrated embodiment, the diameter of the central tube 51 is substantially less than one half the diameter of the drum, and preferably the diameter is about one fourth the drum diameter. Thus in the case of a drum 12 having a diameter of eight feet, the central tube 51 preferably has a diameter of about two feet and an axial length of about two feet or less, so as to not unduly interfere with the desired showering of the cascading aggregate. The diameter of the tubes 50, and the length of the tubes 50 are both selected so that the tubes 50 are able to carry the desired volume of the heated gasses and so as to permit the temperature of the exhaust gas to be varied to a desired extent.

In operation, the aggregate is continuously introduced through the inlet chute 22 into the upper end 16 of the rotating drum 12, and so that the aggregate cascades through the interior of the drum and moves toward the outlet openings 24 at the lower end 17. Also, with the burner 28 in operation, heated gases flow through the length of the drum and exhaust through the outlet duct 30 to a filtering baghouse or the like. In the event an operating parameter changes, the temperature of the exhaust gas may change, which may cause the gas to have a detrimental effect on the filtering baghouse for the reasons noted above. For example, it will be assumed that the apparatus is initially designed to effectively process a mixture of 50 percent virgin aggregate and 50 percent RAP, with the central tube 51 being closed as shown in FIG. 4. If the mixture is changed to 100 percent virgin aggregate, while maintaining the same production rate, the temperature of the exhaust gas will drop by reason of the fact the increased volume of the virgin aggregate will absorb increased heat energy. This drop in temperature may be below an acceptable range for the operation of the baghouse, and to correct this problem, the central tube 51 may be partially or fully opened as shown in FIG. 5. A portion of the hot gas then bypasses the cascading aggregate, and the temperature of the exhaust gas will therefore rise. With other changes of the operating parameters, the temperature may unduly rise, and the temperature may be lowered by closing the central tube 51.

Figure 6:
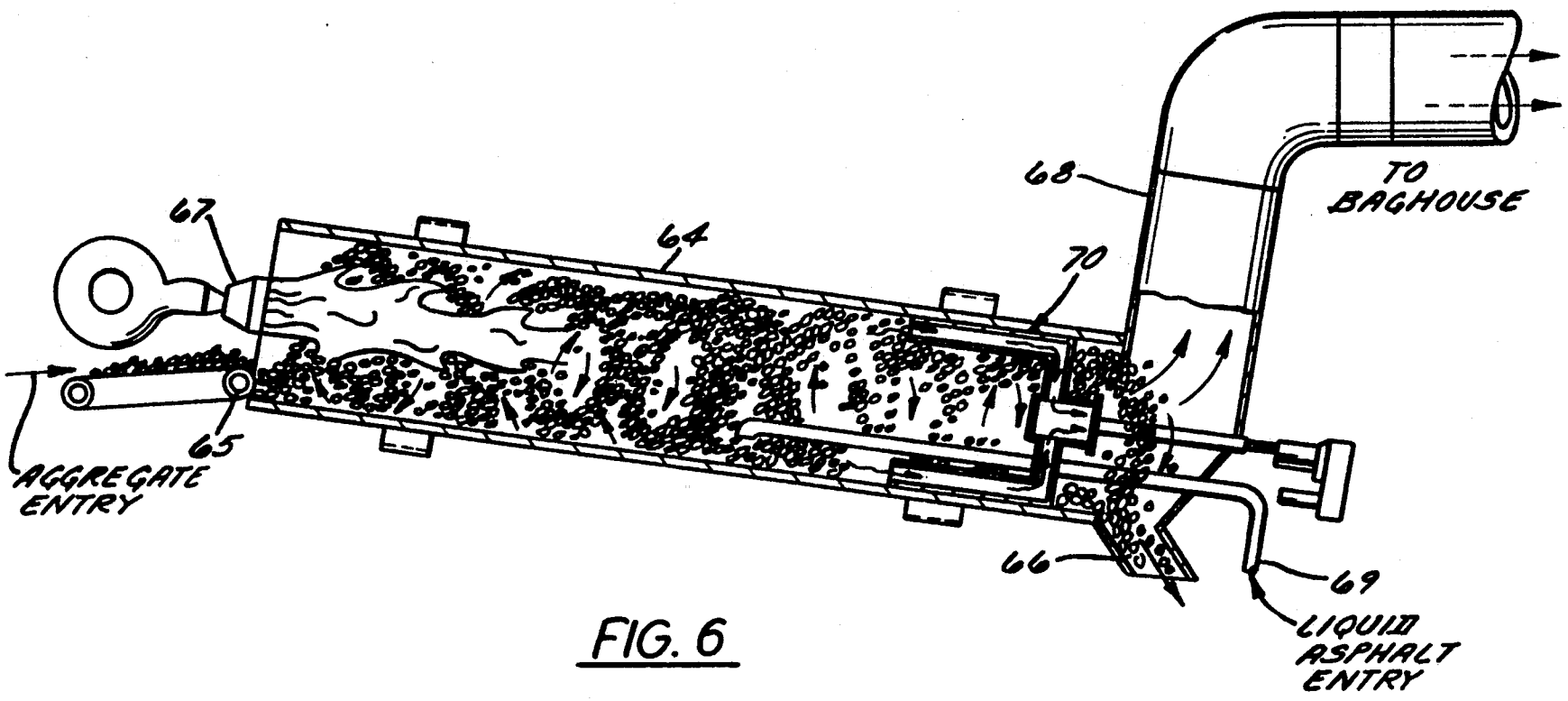
FIG. 6 is a side elevation view of a second embodiment of a drum mixer of the parallel flow type and which includes the features of the present invention.

In the embodiment of FIG. 6, the rotatable drum 64 is similarly mounted for rotation about an axis which is inclined with respect to the horizontal, with the aggregate inlet 65 being positioned adjacent the upper end of the drum and the aggregate outlet 66 being positioned adjacent the lower end of the drum. In this embodiment however, the burner 67 is disposed adjacent the upper end of the drum 64 so that the aggregate moves through the drum in a direction parallel to the direction of the gas flow through the drum, and the exhaust duct 68 communicates with the lower end of the drum 64. Also, a pipe 69 extends longitudinally into the lower end of the drum for introducing liquid asphalt into the interior of the drum so that it is mixed with the aggregate therein. The gas flow bypass means 70 in the drum as illustrated in FIG. 6 operates in a manner similar to that described above with respect to the tubes 50, 51, and 52 of the embodiment of FIGS. 1-5.

The exhaust duct 68 leads to a filtering baghouse (not shown) for filtering the exhaust gas before it is released to the atmosphere. The baghouse is of conventional design, and it typically comprises a plurality of vertically depending bags through which the air flow passes. Also, the baghouse may include a blower associated with a discharge stack.

The embodiment of FIG. 6 is particularly useful in the production of "cold" asphalt paving composition. Such composition is produced utilizing a liquid asphalt having a high percentage of volatiles, which permits the composition to be stored under cold conditions and subsequently used for example in patching an existing roadway. Once in place, the volatiles of the cold composition evaporate, causing the composition to set up and harden.

In the production of cold asphalt, it is important that the liquid asphalt not be unduly heated, since it will easily ignite. Thus, in conventional parallel flow drum mixers, the temperature of the heated gas from the burner is necessarily relatively low, and this will result in a low exhaust temperature which may cause damage to the baghouse from condensation. With the present invention, the bypass means may be utilized to maintain the exhaust temperature at an acceptably high level, without risk of overheating the liquid asphalt. In some installations, it may be preferable to have the outlet of the asphalt delivery pipe 69 located downstream of the inlet end of the bypass means 70 to minimize the risk of overheating and ignition of the liquid asphalt.

In the drawings and specification, there has been set forth a preferred embodiment of the invention, and although specific terms are employed, they are used in a generic and descriptive sense only and not for purposes of limitation.

That which is claimed is:

1. A drum mixer adapted for heating and drying stone aggregate in the continuous production of asphalt paving composition or the like, and comprising an elongate hollow drum defining a central axis, means mounting said drum for rotation about said central axis and with said central axis being inclined with respect to the horizontal so as to define an upper end and a lower end of said drum, aggregate inlet means positioned adjacent said upper end of said drum for introducing aggregate into the interior of said drum, aggregate outlet means positioned adjacent said lower end of said drum for withdrawing the aggregate from the interior of said drum, means for rotating said drum about said central axis so as to cause the aggregate which is introduced at said inlet means to cascade through the interior of said drum and move to said outlet means, heating means positioned adjacent one of said ends of said drum for introducing heated gas into the interior of said drum, exhaust duct means positioned adjacent the other of said ends of said drum for exhausting the heated gas therefrom and so that the heated gas flows through said drum, gas flow bypass means positioned within the interior of said drum for selectively permitting some of the heated gas flowing through said drum to pass freely through a portion of the length of said drum without passing through the cascading aggregate, said gas flow bypass means comprising at least one axially directed elongate tube positioned within said drum adjacent the wall thereof, and with said at least one elongate tube defining an upstream end and a downstream end, a relatively short central tube mounted coaxially within said drum and so as to be radially aligned with said downstream end of said at least one elongate tube, a radial tube interconnecting the downstream end of said at least one elongate tube and said central tube, and valve means for selectively closing said central tube so as to control the flow of heated gasses through said central tube and through said at least one elongate tube.

2. The drum mixer as defined in claim 1 wherein a plurality of said elongate tubes are positioned within said drum and so as to be angularly separated from each other when viewed in transverse cross section, and wherein a like number of said radial tubes interconnect respective ones of said elongate tubes with said central tube.

3. The drum mixer as defined in claim 2 wherein said valve means comprises plate means mounted for movement between a closed position closing one end of said central tube and an open position withdrawn from said one end of said central tube, and drive means for selectively moving said plate means between said open and closed positions.

4. The drum mixer as defined in claim 3 wherein said hollow drum includes a plurality of axially extending mixing flights mounted to the wall of said drum so as to be positioned within said drum, and wherein each of said elongate tubes is mounted immediately behind one of said mixing flights when viewed in the direction of rotation of said drum.

5. The drum mixer as defined in claim 1 wherein said gas flow bypass means is mounted adjacent the end of said drum opposite said heating means, and said at least one elongate tube extends for a substantial portion, but not more than about one half, of the axial length of said drum.

6. The drum mixer as defined in claim 1 wherein said heating means is disposed adjacent said lower end of said drum so that the aggregate moving through said drum moves counter to the direction of the gas flow through said drum.

7. The drum mixer as defined in claim 6 further comprising a fixed sleeve mounted coaxially about at least a portion of the length of said drum and so as to define an annular chamber between said drum and sleeve, said sleeve having a lower end overlying said outlet means of said drum and an upper end positioned intermediate the length of said drum, with said outlet means of said drum opening into said annular chamber so as to receive the heated and dried aggregate therein, and with said sleeve further including a discharge opening adjacent said upper end thereof.

8. The drum mixer as defined in claim 7 wherein said drum includes mixing vane means mounted to the exterior thereof and so as to be positioned within said annular chamber for mixing the aggregate received therein upon rotation of said drum and moving the aggregate toward said discharge opening of said sleeve.

9. The drum mixer as defined in claim 8 further comprising means for introducing liquid asphalt or the like into said annular chamber so as to be mixed with the aggregate therein.

10. The drum mixer as defined in claim 9 further comprising means positioned adjacent said lower end of said sleeve for introducing an additive, such as recyclable asphalt pavement, into said annular chamber so as to be mixed with the aggregate and the liquid asphalt therein.

11. The drum mixer as defined in claim 1 wherein said heating means is positioned adjacent said upper end of said drum so that the aggregate moves through said drum in a direction parallel to the direction of the gas flow through said drum.

12. The drum mixer as defined in claim 11 further comprising means for introducing liquid asphalt into the interior of said drum so as to be mixed with the aggregate therein.

13. The drum mixer as defined in claim 1 further comprising a filtering baghouse communicating with said exhaust duct means for filtering the exhaust gas before it is released to the atmosphere.

14. The drum mixer as defined in claim 1 wherein said heating means comprises a burner for directing a high temperature flame into said drum, and air blower means for supplying air to said burner.

15. A drum mixer useful in the continuous production of asphalt paving composition, and which is characterized by the ability to maintain the exhaust gas temperature within acceptable limits under varying operating conditions, and comprising an elongate hollow drum defining a central axis, means mounting said drum for rotation about said central axis and with said central axis being inclined with respect to the horizontal so as to define an upper end and a lower end of said drum, aggregate inlet means positioned adjacent said upper end of said drum for introducing aggregate into the interior of said drum, aggregate outlet means positioned adjacent said lower end of said drum for withdrawing aggregate from the interior of said drum, means for rotating said drum about said central axis so as to cause the aggregate which is introduced at said inlet means to cascade through the interior of said drum and move to said outlet means, heating means positioned adjacent said lower end of said drum for introducing heated gas into the interior of said drum, exhaust duct means positioned adjacent said upper end of said drum for exhausting the heated gas therefrom and so that the heated gas flows through said drum, a fixed sleeve mounted coaxially about a portion of the length of said drum adjacent said lower end thereof and so as to define an annular chamber between said drum and sleeve, said sleeve having a lower end overlying said outlet means of said drum and an upper end positioned intermediate the length of said drum, with said outlet means of said drum opening into said annular chamber so as to receive the heated and dried aggregate therein, and with said sleeve further including a discharge opening adjacent said upper end thereof, mixing vane means mounted to the exterior of said drum and so as to be positioned within said annular chamber for mixing the aggregate received therein upon rotation of said drum and moving the aggregate toward said discharge opening of said sleeve, means for introducing liquid asphalt into said annular chamber so as to be mixed with the aggregate therein, and gas flow bypass means positioned within the interior of said drum for selectively permitting some of the heated gas flowing through said drum to pass freely through a portion of the length of said drum and to said exhaust duct means without passing through the cascading aggregate, said gas flow bypass means comprising a plurality of axially directed elongate tubes each positioned within said drum adjacent the wall thereof, and with said tubes defining aligned upstream ends and aligned downstream ends, a relatively short central tube mounted coaxially within said drum and so as to be radially aligned with said downstream ends of said elongate tubes, a plurality of radial tubes interconnecting the downstream end of respective ones of said elongate tubes and said central tube, and valve means for selectively closing said central tube so as to control the flow of heated gasses through said central tube and through said elongate tubes.

16. The drum mixer as defined in claim 15 further comprising means positioned adjacent said lower end of said sleeve for introducing an additive, such as recyclable asphalt pavement, into said annular chamber so as to be mixed with the aggregate and the liquid asphalt therein.

17. The drum mixer as defined in claim 15 wherein said gas flow bypass means is a mounted adjacent said upper end of said drum, and said plurality of axially directed elongate tubes each extend for a substantial portion of the axial length of said drum.

18. The drum mixer as defined in claim 17 wherein said hollow drum includes a plurality of axially extending mixing flights mounted to the wall of said drum so as to be positioned within said drum, and wherein each of said elongate tubes is mounted immediately behind one of said mixing flights when viewed in the direction of rotation of said drum.

* * * * *